US007265767B2

(12) United States Patent
Forest et al.

(10) Patent No.: US 7,265,767 B2
(45) Date of Patent: Sep. 4, 2007

(54) ILLUMINATED RIBBON SHIELD

(76) Inventors: Scott Forest, 212 Shiloh Rd., Hope, NJ (US) 07844; Albert Van Grouw, III, 620 High Mountain Rd., North Haledon, NJ (US) 07508

( * ) Notice: Subject to any disclaimer, the term of this patent is extended or adjusted under 35 U.S.C. 154(b) by 355 days.

(21) Appl. No.: 11/091,789

(22) Filed: Mar. 18, 2005

(65) Prior Publication Data

US 2006/0209158 A1 Sep. 21, 2006

(51) Int. Cl.
*B41J 17/30* (2006.01)
*B41J 35/06* (2006.01)
*B41J 35/26* (2006.01)

(52) U.S. Cl. ..... 346/82; 400/248

(58) Field of Classification Search ..... 400/248; 346/80–82

See application file for complete search history.

(56) References Cited

U.S. PATENT DOCUMENTS 6,558,055 B1 * 5/2003 Shishido et al. ..... 400/248
2006/0209100 A1 * 9/2006 Forest et al. ..... 347/2

* cited by examiner

*Primary Examiner*—Huan Tran
(74) *Attorney, Agent, or Firm*—Stetina Brunda Garred & Brucker

(57) ABSTRACT

A ribbon shield for a time clock may be provided which may be placed within a printing chamber along with a printing mechanism. The ribbon shield may also incorporate a light source (e.g., electroluminescent lamp) to illuminate the printing chamber and an inserted time card to aid an employee in aligning a time slot of the time card to a printing mechanism target area.

10 Claims, 6 Drawing Sheets

ILLUMINATED RIBBON SHIELD

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates generally to a time clock, and more particularly, to a time clock having an illuminated printing chamber and/or patron guidance light.

Time clocks are used by businesses to keep track of time worked by hourly employees. To this end, time clocks may be positioned or located at entrances or exits of a business. Also, employees may be assigned or given a time card at the beginning of each week to indicate thereon the time worked by the employee via the time clock. The time card may have a plurality of time slots for the days of the week (e.g., Monday, Tuesday, Wednesday, Thursday, Friday, Saturday, and Sunday) as well as for various times during the day (e.g., start work, start and end of lunch time, and end work). And, the time clock stamps start and end times of the time worked on respective time slots.

The time card for each employee may be placed at a central location adjacent the time clock. Each employee, when first coming to work at the beginning of the day, may insert his/her time card into the time clock and depress a print button to actuate a printing mechanism of the time clock to stamp a current time on the time card thereby indicating the time at which the employee started work. In particular, when the employee inserts the time card into the time clock, the employee aligns the time slot of the time card to the printing mechanism of the time clock by viewing both the printing mechanism and the time slot through a print window. However, the print window may not provide optimal viewing of the printing mechanism and the time slot because the time clock cover shades or blocks any ambient light from the printing mechanism and the time slot. The only light falling on the printing mechanism and the time slot is ambient light through the print window. As a result, the employee may not be able to see whether the appropriate time slot is aligned to the printing mechanism, and the time card may have a plurality of stamped times which are misaligned to the appropriate time slots. Hence, an accountant who calculates the time worked by the employee may have difficulty in reading the plurality of stamped times on the time card.

Additionally, when the employee looks through the print window, it is sometimes unclear to the employee where the time slot should be aligned: the employee only sees a plurality of mechanical parts. As such, the employee may misalign the time slot because the employee does not know what part to align the time slot to.

Accordingly, there is a need for an improved time clock.

BRIEF SUMMARY OF THE INVENTION

The deficiencies in the prior art are addressed by the present invention illustrated herein. In an embodiment of the present invention, a time clock having a printing mechanism and ribbon shield within a printing chamber may be provided. The ribbon shield may be placed under the printing mechanism to guide a time card under the printing mechanism and to shield the time card from a cartridge ribbon of the printing mechanism during a printing process of the printing mechanism. When the printing mechanism is in an idle position, the printing mechanism is moved out of the way such that a time slot of the time card may be viewed through a print window and a cut out of the ribbon shield. When the printing mechanism is in a print position, the printing mechanism is moved toward the time card and imprints a current time onto the time slot of the time card.

The ribbon shield may incorporate a light source which when illuminated may illuminate the printing chamber, time card time slots and printing mechanism. Hence, the ribbon shield may aid employees in aligning the time slot with the printing mechanism by illuminating the printing chamber such that the employee may see the printing mechanism and time card time slot.

The light source incorporated into the ribbon shield may employ various lighting technologies. For example, a light emitting diode (LED), electroluminescent lamp or other light source may be incorporated into the ribbon shield. Preferably, an electroluminescent lamp (EL) may be incorporated into the ribbon shield. In particular, the EL may be incorporated at a medial portion of the ribbon shield. Further, illumination of the EL may direct light toward the printing mechanism and into the printing chamber. Light reflected off of the printing chamber surfaces may subsequently illuminate the time card time slots which may provide even illumination of the time slot compared to direct illumination of the time slots by the light source (e.g., LED).

The EL may form a medial portion of the ribbon shield. In particular, the EL may comprise a lower conductor and an upper conductor. A phosphor may also be interposed between the lower and upper conductors. The phosphor may then be excited/illuminated by energizing the phosphor with an alternating electric field. The alternating electric field may be provided to the phosphor by placing the lower and upper conductors in electrical communication with an alternating current. Further, the upper conductor may be fabricated from a transparent material such that the illuminated phosphor may pass light through the upper conductor to illuminate the printing chamber and subsequently the time card time slots.

The phosphor may be interposed between the upper conductor and the lower conductor in a U-shaped pattern around a cut out of the ribbon shield. Additionally, the phosphor may be interposed between the upper conductor and the lower conductor in an arrow pattern pointing to the U-shaped pattern. Accordingly, when the EL lamp is illuminated, the phosphor illuminates light in the shape of an arrow pointing to the U-shaped illumination to indicate to the employee that the time slot should be aligned inside of the U-shaped illumination. Additionally, the phosphor may be interposed between the upper conductor and the lower conductor in a rectangular shape. The upper conductor may have opaque portions patterned such that illumination through the transparent portion forms letters (e.g., INSERT) and/or arrows. This arrangement provides direction to the employee as to where the time slot should be aligned to.

BRIEF DESCRIPTION OF THE DRAWINGS

An illustrated and presently preferred embodiment of the present invention is shown in the accompanying drawings in which.

DETAILED DESCRIPTION OF THE INVENTION

Figure 1:
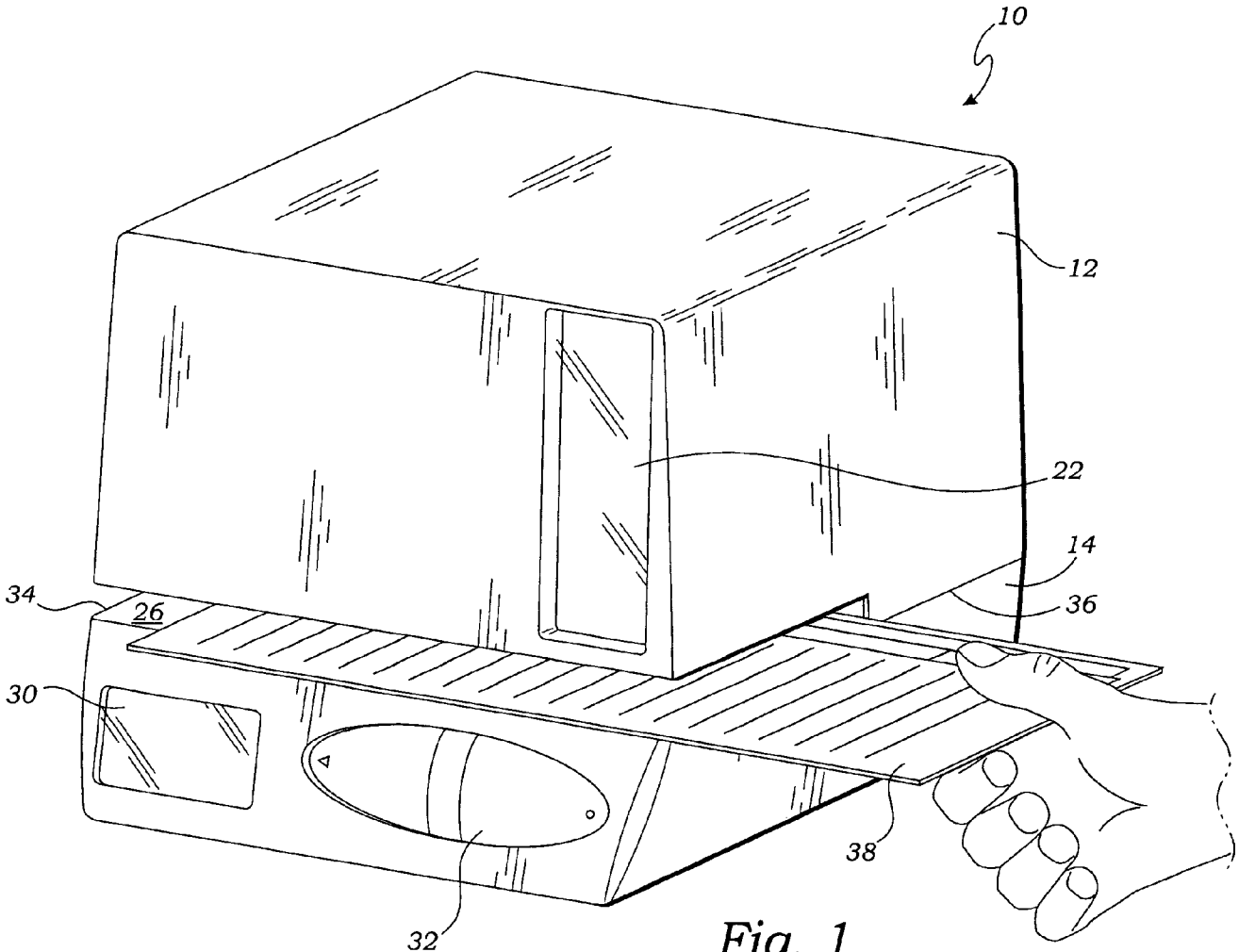
FIG. 1 is a perspective view of a time clock with a hand of a user aligning a time card time slot through a print window.
Figure 2:
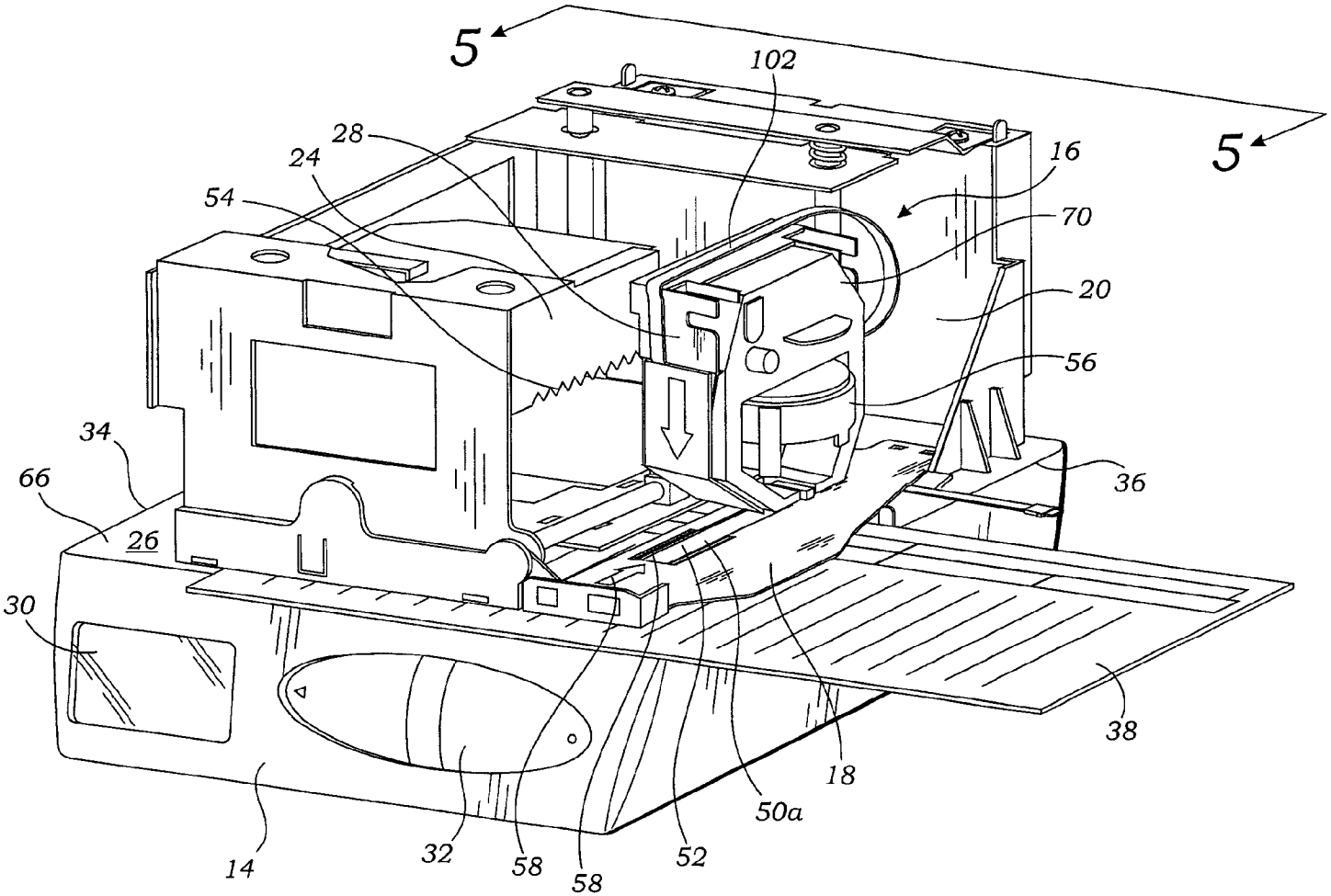
FIG. 2 is a perspective view of the time clock showing a ribbon shield and printing mechanism within a printing chamber of the time clock.

The figures referred to herein are for the purpose of illustrating the preferred embodiments of the present invention and not for the purpose of limiting the same. FIG. 1 illustrates a perspective view of a time clock 10. The time clock 10 includes a cover 12 and a base 14. The cover 12 encloses various electronic components of the time clock 10 such as a printing mechanism 16 (see FIG. 2) and a ribbon shield 18 (see FIG. 2) within a printing chamber 20 (see FIG. 2) which may be viewed through a print window 22 (see FIG. 1) of the cover 12. As shown in FIG. 2, the printing chamber 20 is the volume of space defined by parts surrounding the printing mechanism 16 such as a frame 24, a printer platen 26, the ribbon shield 18, housing 28 and cover 12 (see FIG. 1). As shown in FIGS. 1 and 2, the base 14 includes a clock 30 (e.g., analog or digital), a print button 32 and a printer platen 26. The printer platen 26 may extend across the entire base 14 from a left edge 34 to a right edge 36. The printer platen 26 and the printing mechanism 16 may work in conjunction with each other to imprint a time indicated by the clock 30 onto a time card 38.

Figure 3:
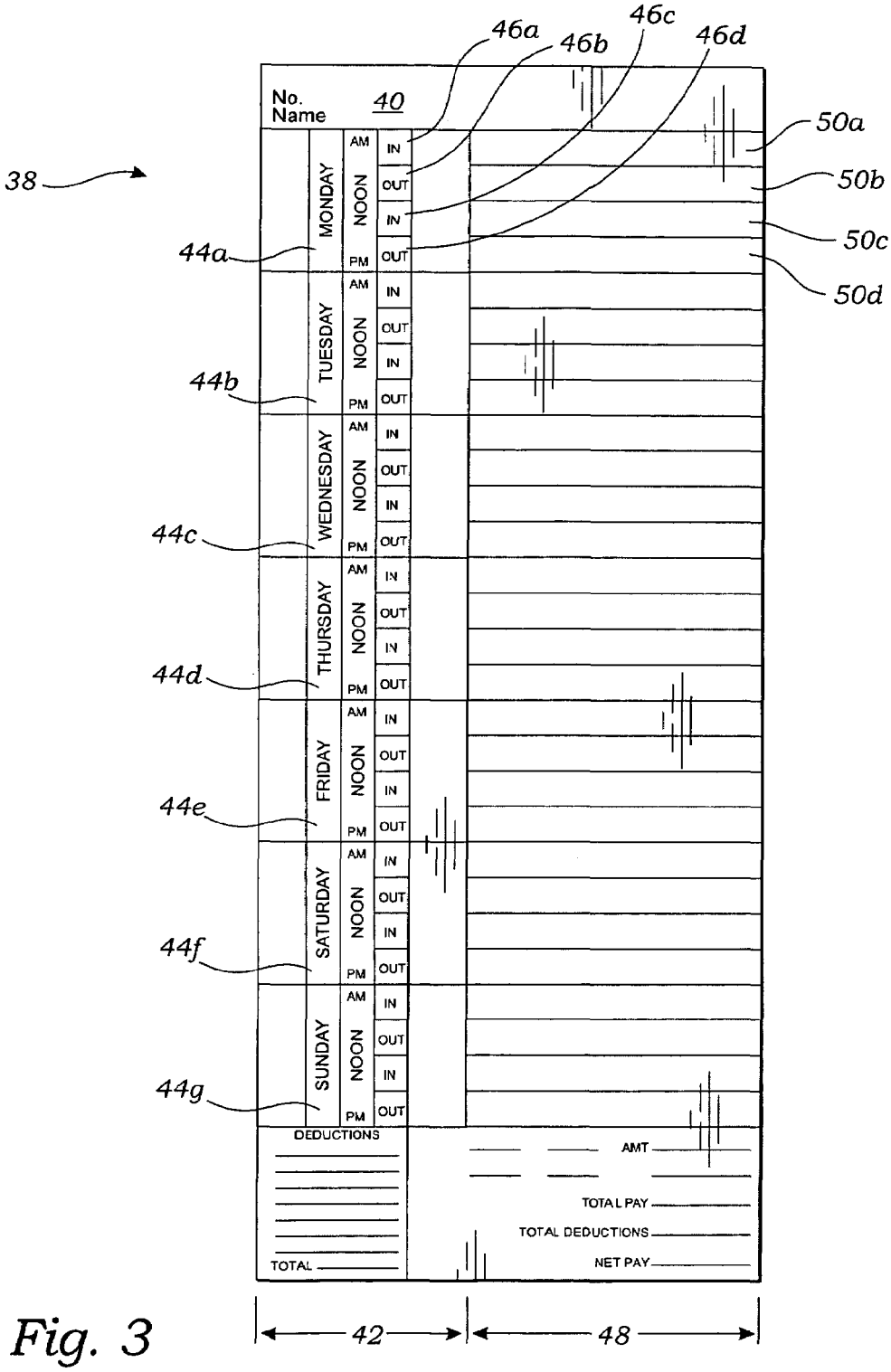
FIG. 3 is a top view of the time card.

The time card 38 is more clearly shown in FIG. 3. The time card 38 may have a front surface 40 and a rear surface. The time card 38 along a left portion 42 may have indicia to represent days 44*a-g* of week and also start and end points 46*a-d* throughout the work day. For example, the left portion 42 may identify the day of the week such as MONDAY 44*a*, TUESDAY 44*b*, WEDNESDAY 44*c*, THURSDAY 44*d*, FRIDAY 44*e*, SATURDAY 44*f*, and SUNDAY 44*g*. The start and end points 46*a-d* may be the start of work 46*a*, the start of lunch/break 46*b*, the end of lunch/break 46*c* and the end of work 46*d*. The time card 38 along a right portion 48 may have a corresponding time slot 50*a-d* for each start and end points 46*a-d* and for each day 44 of the week. Accordingly, the time card 38 shown in FIG. 3 has a total of twenty eight (28) time slots 50. Time slot 50*a* is associated with the start of work 46*a*, time slot 50*b* is associated with the start of lunch/break 46*b*, time slot 50*c* is associated with the end of lunch/break 46*c*, and time slot 50*d* is associated with the end of work 46*d*. Although the time card 38 used to explain the various aspects of the present invention is a weekly time card 38, the various aspects of the present invention may be employed with time cards 38 having different periods.

The time clock 10 may be located at a business, and more particularly, may be placed near an entrance/exit of the business used by employees to come to and to leave work. Employees of the business may be given a time card 38 to record the hours worked by the employee. These time cards 38 may also be placed near the entrance or exit, near the time clock. The employee may record his/her time worked by stamping a start work time at the beginning of the work day, stamping a start lunch/break time at the beginning of lunch/break, stamping an end of lunch/break time at the end of lunch/break and stamping an end work time at the end of the work day. For example, the employee at the beginning of the work day may insert the time card 38 into a slot formed by the printer platen 26 and the ribbon shield 18 and align the time slot 50*a* to a target area 52 (see FIG. 2) of the printing mechanism 16. Once the time slot 50*a* is aligned to the printing mechanism 16, the employee may press the print button 32 which may activate the printing mechanism 16 to print the time indicated on the clock 30 onto the time card 38 at the time slot 50*a*. In particular, depressing the print button 32 may activate the printing mechanism 16 to move forward via a rack 54 and pinion and activate a print head 56 to move downward to imprint the time onto the time card 38. Throughout the day, the employee may stamp the time card via the time clock to indicate when the employee started his/her lunch/break, ended his/her lunch/break and ended work.

Figure 4:
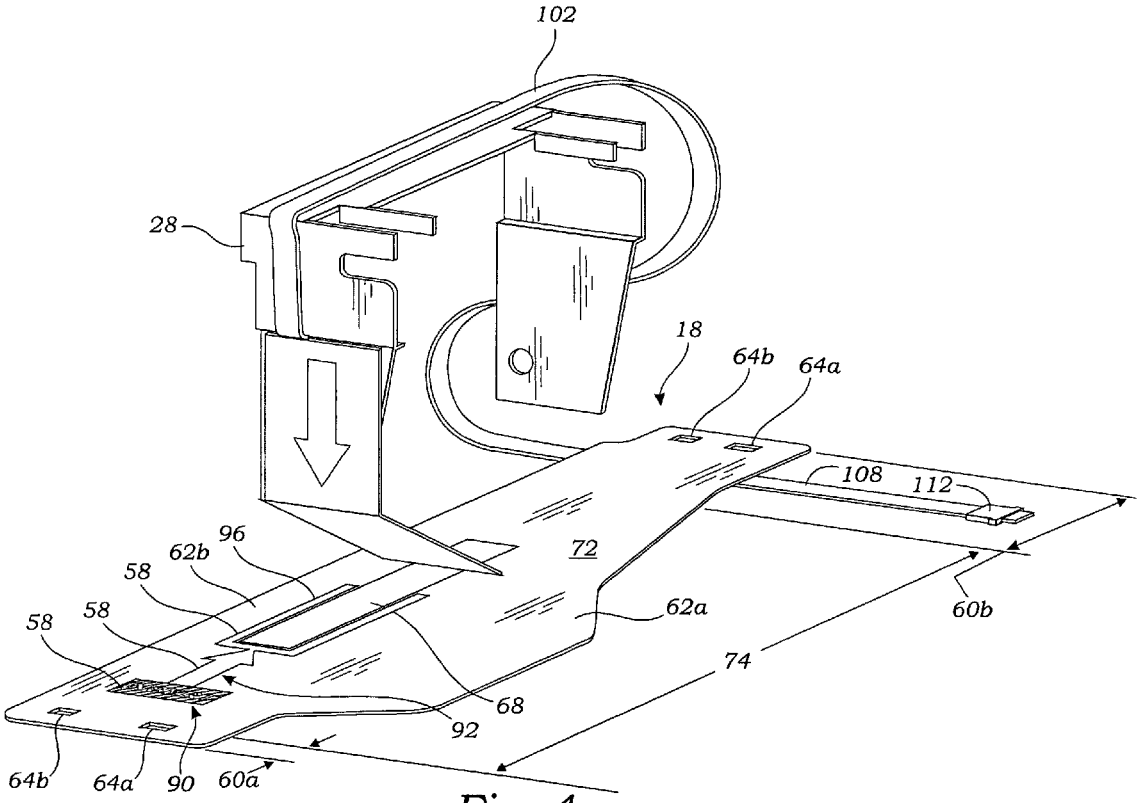
FIG. 4 is a perspective view of the ribbon shield illustrating a cut out, first strip connectable to a power source and a second strip with an arrow indicia wrapped about a housing.

The alignment of the time slot 50 to the printing mechanism target area 52 may be facilitated via a light source 58 (see FIGS. 2 and 4) within the printing chamber 20. The light source 58 may be incorporated in the ribbon shield 18. The ribbon shield 18, as shown in FIG. 4, may have a sheet configuration defining opposed lateral portions 60*a, b* and opposed longitudinal portions 62*a, b*. The opposed lateral portions 60*a, b* may each be formed with locating apertures 64*a, b* sized and configured to mate with corresponding nubs formed on the frame 24 of the time clock 10 to hold the ribbon shield 18. The ribbon shield 18, when attached to the time clock frame 24 via the locating apertures 64 and respective nubs, may be substantially parallel to the printer platen 26. Moreover, a lower surface of the ribbon shield 18 and an upper surface 66 of the printer platen 26 may define the slot to provide for horizontal maneuverability of the time card 38 with respect to the printing mechanism 16 but limit vertical movement of the time card 38. The ribbon shield 18 may further have a cut out 68 (i.e., aperture; see FIG. 4) to allow the print head 56 to pass therethrough and indicate the time clock time on the time card 38.

The printing mechanism 16 may include the housing 28 (see FIGS. 2 and 4), a ribbon cartridge 70 (see FIG. 2) and the print head 56 (see FIG. 2). The ribbon cartridge 70 may be removeably attachable to the housing 28. The housing 28 may be attached to the frame 24 along with the print head 56. The housing 28, cartridge 70 and print head 56 may move forward, and the print head 56 may move downward onto a ribbon of the cartridge 70 and through the cut out 68 when the print button 32 is depressed to indicate the time clock time onto the time card 38.

Figure 5:
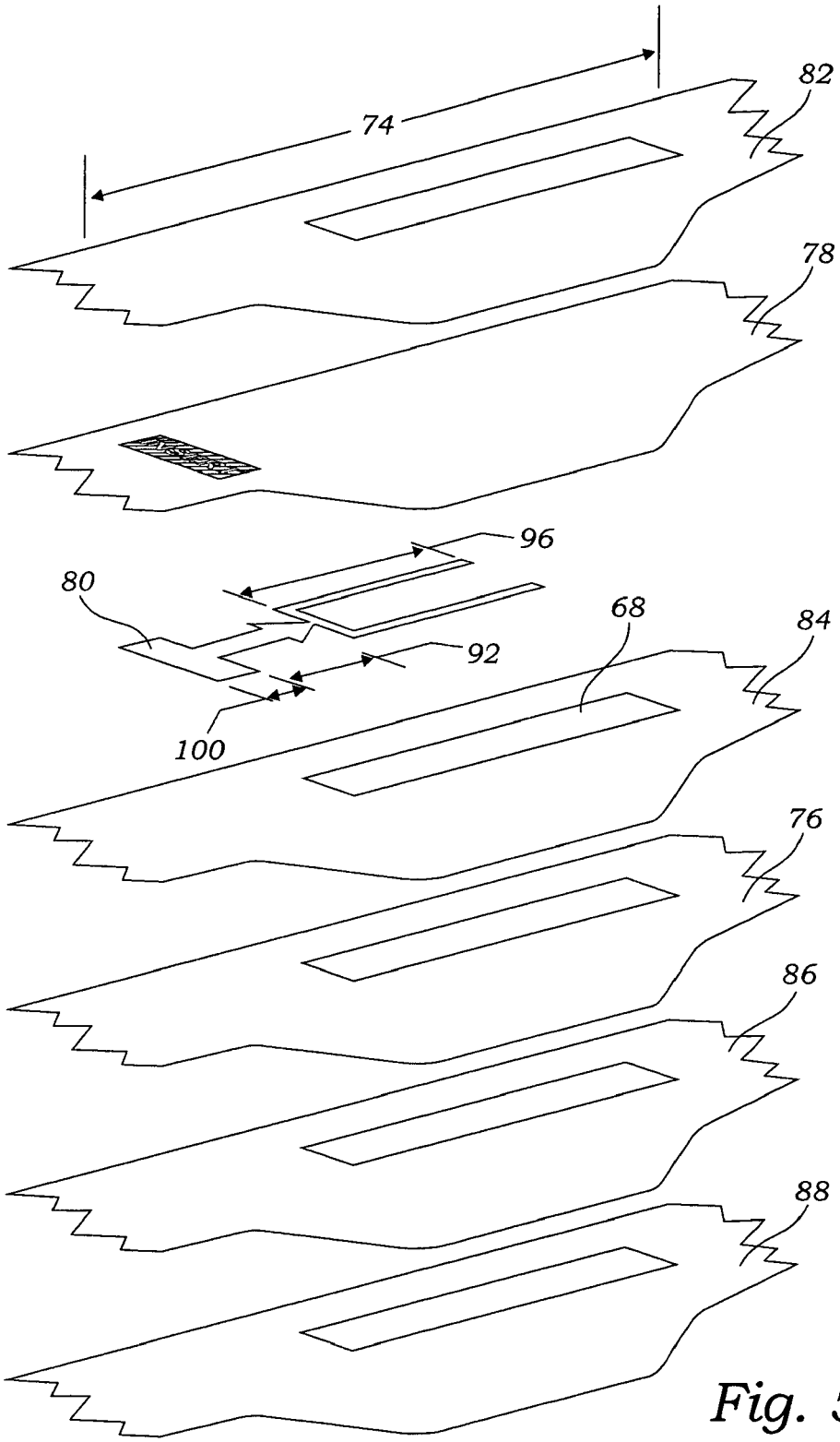
FIG. 5 is an exploded perspective view of the electroluminescent lamp of FIG. 4.

Light from the light source 58 may be emitted through a top surface 72 of the ribbon shield 18. In particular, the ribbon shield 18 may define a medial portion 74. The medial portion 74 may be an electroluminescent lamp. For example, as shown in FIG. 5, the medial potion 74 may include a lower conductor 76 and an upper conductor 78. Phosphor 80 may be interposed between the lower and upper conductors 76, 78. The phosphor 80 may be energized with an alternating electric field by placing the lower and upper conductors 76, 78 in electrical communication with an alternating current. The upper conductor 78 may also be fabricated from a transparent material to allow the illuminated phosphor/energized phosphor 80 to light the print chamber 20 which in turn lights the cut out 68 of the ribbon shield 18 and the time slot 50 when the time card 38 is inserted between the printer platen 26 and the ribbon shield 18. The printing chamber 20 may also be colored white to help reflect more light through the cut out 68 and onto the time slot 50. Accordingly, the employee may be able to see the time slot 50 to properly align the time slot 50 to the printing mechanism target area 52.

The medial portion 74 may also comprise a filter layer 82 on top of the upper conductor 78. The phosphor may be sputtered onto a dielectric layer 84. Also, the lower conductor 76 may be laid on a polyester film base 86. Lastly, an optional adhesive layer may be formed on the bottom of the film base 86.

The ribbon shield may also illuminate words 90 (see FIG. 4), arrows 92 (see FIGS. 4 and 5) and shaped light 96 (see FIGS. 4 and 5) to help the employee in aligning the time slot 50 to the printing mechanism target area 52. As stated above, the phosphor 80 is excited and illuminates through the transparent upper conductor 78. The phosphor 80 may also be laid on a dielectric layer 84 as a pattern (see FIG. 5) to help the employee in seeing the time slot 50 and/or informing the employee where the time slot 50 should be aligned to. For example, the phosphor 80 may be laid on the dielectric layer 84 around the cut out 68 in a U-shape 96 (see FIG. 5) such that illumination of the phosphor 80 produces a U-shaped light and intuitively indicates that the time slot 50 should be aligned within the U-shaped 96 light. The area within the U-shaped light may be the printing mechanism target area 52. The phosphor 80 may also be laid on the dielectric layer 84 in an arrow shape 98 pointed to the U-shape 96 (see FIG. 5) such that illumination of the phosphor 80 produces an arrow shaped light pointing to the U-shaped light 96. This further emphasizes to the employee that the time slot 50 should be aligned within the U-shaped light as directed by the arrow shaped light. The phosphor 80 may also be laid on the dielectric layer in a rectangular shape 100. Also, the transparent upper conductor 78 may be etched or made opaque as a negative of a word such as INSERT, as shown in FIG. 5. As such, when the rectangular patch 100 of phosphor 80 is illuminated, the term "INSERT" 90 is seen by the employee through the print window 22 to inform the employee that the time slot 50 should be aligned within the U-shaped light 96.

Figure 7:
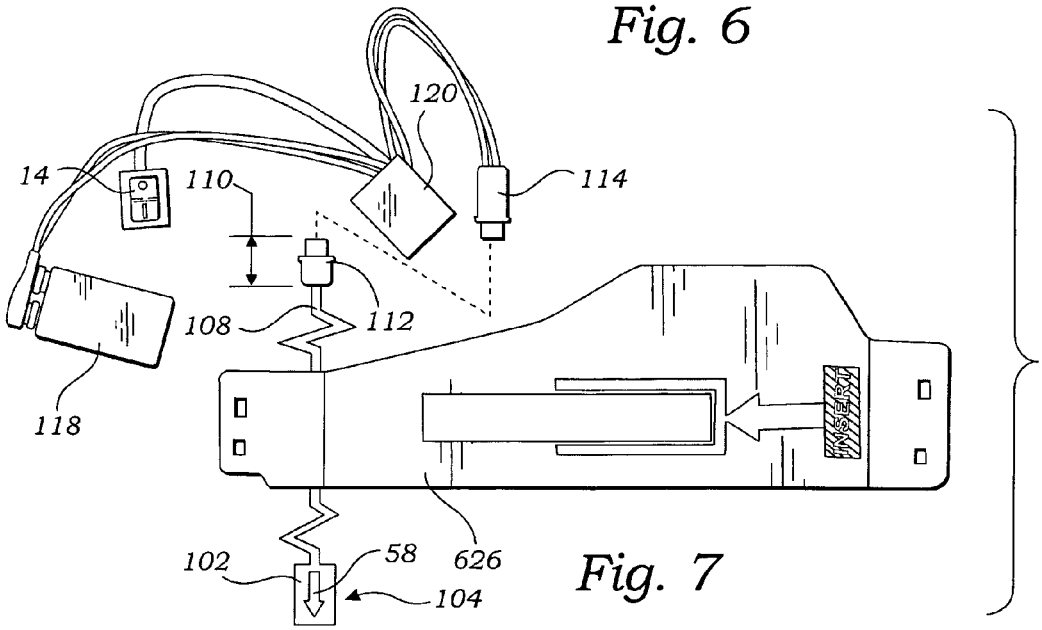
FIG. 7 illustrates a DC power source powering the electroluminescent lamp.

The ribbon shield 18 may further comprise a first strip 102. The first strip 102 may be connected to the longitudinal portion 62*b*. The first strip 102 may also be formed to have a light source 58 such as an electroluminescent lamp. As shown in FIGS. 4 and 7, a distal end 104 of the first strip 102 may have the light source 58 (e.g., electroluminescent lamp) shaped as an arrow 106. The first strip 102 may be wrapped around the housing 28 such that the first strip arrow 106 points downward and is directly above the printing mechanism target area 52 to indicate to the employee that the time slot 50 should be aligned directly below the first strip arrow 106.

The ribbon shield may further comprise a power strip or second strip, as shown in FIGS. 4 and 7. A distal end 110 of the power strip 108 may further have a first connector 112 to receive alternating current therethrough. The first connector 112 may also be connected to conductive elements formed on the power strip 108 and to the lower and upper conductors 76, 78 to provide the necessary alternating electric field to the phosphor 80 for illuminating the same.

The first connector 112 may be attached to a second connector 114. The second connector or mating connector 114 may be connected to a power source of the time clock 10. In particular, the time clock 10 may be powered via a power cord 116 (see FIG. 6) plugged into an electrical outlet of a building. The electricity provided by the electrical outlet may pass through a step up or step down transformer of the time clock 10 as needed by the various electrical components of the time clock 10. The transformed power or time clock power source may supply electricity to the mating connector 114 to supply the alternating electrical field required by the electroluminescent lamp 58. Alternatively, the electroluminescent lamp 58 may be powered via a standard 9-volt battery 118, as shown in FIG. 7. In particular, the 9-volt battery 118 may be placed in electrical communication with an inverter 120 to convert the 9-volt DC power into alternating current. The inverter 120 may be in electrical communication to the mating connector 114. The circuit shown in FIG. 7 may also be serially connected to a first on/off switch 122 to turn the light source 58 on/off.

Figure 6:
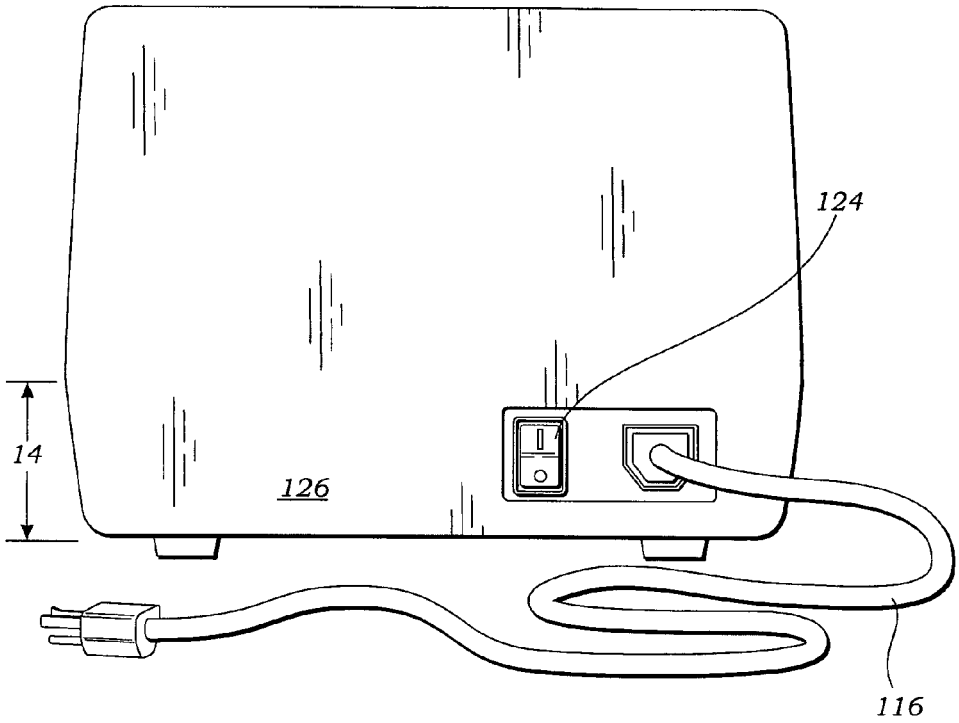
FIG. 6 is a rear view of the time clock of FIG. 2.

The electric circuit of the electroluminescent lamp 58 may be placed serially with a second on/off switch 124 (see FIG. 6). The second on/off switch 124 may be positioned on a back surface 126 of the base 14. When the second on/of switch 124 is traversed to an on position, the electroluminescent lamp 58 may be powered on to illuminate the printing chamber 20. In other words, the printing chamber 20 is always illuminated. Conversely, when the second on/off switch 124 is traversed to an off position, the electroluminescent lamp 58 may be powered off. In other words, the printing chamber 20 is not illuminated.

Alternatively, and more preferably, the electric circuit of the electroluminescent lamp 58 may further have a sensor connected to a third on/off switch. The sensor may be positioned adjacent to the ribbon shield 18 to sense the presence of a time card 38 inserted between the ribbon shield 18 and the printer platen 26. The sensor may be operative to place the third switch in an on position or an off position depending on whether the time card 38 is sensed or not sensed, respectively. The third switch may also be placed serially with the electroluminescent lamp 58 such that electrical connectivity between the power source and the light source 58 is interrupted when the third switch is placed in the open state (i.e., off position). Conversely, when the third switch is placed in the closed state (i.e., on position), electrical connectivity between the power source and the light source 58 may be established. Accordingly, the light source is illuminated only when needed—employee is punching in or out.

The employee may insert the time card 38 between the ribbon shield 18 and the printer platen 26. The sensor may sense the presence of the time card 38 therebetween. Thereafter, the sensor may place the third switch in the closed position to provide power to the light source 58. This arrangement may provide power to the light source 58 only when needed—when an employee is attempting to align the time card time slot 50 to the print head 56.

This description of the various embodiments of the present invention is presented to illustrate the preferred embodiments of the present invention, and other inventive concepts may be otherwise variously embodied and employed. The appended claims are intended to be construed to include such variations except insofar as limited by the prior art.

What is claimed is:

1. A ribbon shield to guide a time card with respect to a printing mechanism of a time clock, the shield comprising:

a. a body portion defining a lower surface to guide the time card thereunder and a cut out for allowing a print head and a ribbon of the printing mechanism to traverse through the cut out and imprint a time onto the time card under the lower surface;

b. a light source incorporated into the body portion for illuminating the time card under the lower surface.

2. The shield of claim 1 wherein the light source illuminates light through an upper surface of the body portion.

3. The shield of claim 1 wherein the light source is an electroluminescent lamp.

4. The shield of claim 3 wherein the electroluminescent lamp comprises:

a. a lower conductor;

b. an upper conductor; and c. phosphor interposed between the lower conductor and the upper conductor in a shape of an arrow pointing to the cut out.

5. The shield of claim 4 wherein the electroluminescent lamp further comprises:

a. phosphor interposed between the lower conductor and the upper conductor in a U shape around the cut out.

6. The shield of claim 5 wherein the electroluminescent lamp further comprises:

a. phosphor interposed between the lower conductor and the upper conductor in a rectangular shape;

b. wherein the upper conductor is transparent with an opaque portion forming a negative of a word and the opaque portion is sized and positioned with respect to the rectangular shape phosphor.

7. The shield of claim 1 further comprising a sensor operative to turn the light source on and off based on a sensed time card under the lower surface.

8. A time clock for indicating time on a time card, the clock comprising:

a. a base;

b. a clock attached to the base;

c. a printer platen for resting the time card on the printer platen when time indicia is being indicated on the time card;

d. a printing mechanism for indicating time indicia on the time card, the mechanism traverseable between a print position and an idle position, the mechanism impressing time indicia on the card while in the print position and allowing the time card to be interpositioned between the printer platen and the mechanism while in the idle position; and e. a ribbon shield for aiding an employee in aligning the time card to a printing mechanism target area, the ribbon shield comprising:

i. a body portion defining a lower surface to guide the time card thereunder and a cut out for allowing a print head and ribbon of the printing mechanism to traverse through the cut out and indicate a time onto the time card under the lower surface;

ii. a light source incorporated into the body portion for illuminating the time card under the lower surface.

9. The time clock of claim 8 further comprising a sensor operative to activate the light source when a time card is sensed under the lower surface.

10. The time clock of claim 8 wherein the light source is an electroluminescent lamp.

* * * * *